United States Patent [19]

Oglesby et al.

[11] Patent Number: 4,840,372

[45] Date of Patent: Jun. 20, 1989

[54] DIAGNOSTIC TESTING SYSTEM FOR AN EXERCIE MACHINE

[75] Inventors: Gary Oglesby, Lombard; Bryan Andrus, Chicago, both of Ill.

[73] Assignee: Bally Manufacturing Corporation, Chicago, Ill.

[21] Appl. No.: 921,696

[22] Filed: Oct. 21, 1986

[51] Int. Cl.[4] ..... A63B 21/00

[52] U.S. Cl. ..... 272/72; 272/73; 272/DIG. 5; 272/DIG. 6

[58] Field of Search ..... 272/72, 73, DIG. 5, 272/DIG. 6; 364/550, 551, 410, 412; 73/379

[56] References Cited

U.S. PATENT DOCUMENTS

| | | | |
|---|---|---|---|
| 4,099,722 | 7/1978 | Rodesch et al. | 273/143 R |
| 4,358,105 | 11/1982 | Sweeney, Jr. | 272/73 |
| 4,408,183 | 10/1983 | Wills | 272/DIG. 6 |
| 4,493,485 | 1/1985 | Jones | 272/126 |
| 4,537,396 | 8/1985 | Hooper | 272/72 |
| 4,542,897 | 9/1985 | Melton et al. | 272/73 |
| 4,660,833 | 4/1987 | Dickinson et al. | 273/143 R |
| 4,709,917 | 12/1987 | Yang | 272/73 |

*Primary Examiner*—Leo P. Picard

*Attorney, Agent, or Firm*—Jenner & Block

[57] ABSTRACT

A diagnostic testing system for an exercise machine having a computer control. The computer control of the machine is responsive to the actuation of a test button to enter a diagnostic test mode in which various components of the machine may be checked for maintenance. Tests are provided to check the machine's display, keypad, sound generation system, opposition force providing system and speed sensing system. Another test is used to display accounting data which reflects the usage of the machine. The accounting data may be monitored by the computer control to automatically provide an indication to an operator when the data indicates that the machine should have a service check performed.

15 Claims, 4 Drawing Sheets

DIAGNOSTIC TESTING SYSTEM FOR AN EXERCIE MACHINE

TECHNICAL FIELD

The present invention relates to exercise equipment and more particularly to a diagnostic testing system for an exercise machine which allows various components of the machine to be checked for maintenance.

BACKGROUND OF THE INVENTION

Health club facilities typically perform little or no preventive maintenance on their exercise equipment resulting in unnecessary and costly repairs. Perhaps even more important than repair costs is the negative impact that out of service or malfunctioning equipment has on a health club's membership. It is the more sophisticated computer controlled exercise equipment that is used to draw customers into the club and to keep them as satisfied dues paying members. One reason for the lack of maintenance is that the facility operators usually have very little technical training and hence are often leery of sophisticated, computer controlled exercise equipment. To reduce equipment down time as well as to prolong the operation of exercise equipment, health club facilities are in great need of a means to increase the reliability of the equipment. A properly maintained exercise machine not only reduces repair costs and increases the machine's availability but more importantly insures the safety of persons using the machine.

SUMMARY OF THE INVENTION

In accordance with the present invention, the disadvantages of prior exercise machines have been overcome. The exercise machine of the present invention includes a diagnostic testing system which facilitates testing of the machine's components to insure that the machine is properly maintained.

The exercise machine of the present invention is computer controlled and includes a display for providing information to the user as well as a keypad which allows the user to select various exercise options such as the duration of an exercise or the level of difficulty of an exercise. The exercise machine also includes a test input button located in the machine's computer housing at a position which is accessible by authorized personnel. The test input button is coupled to the computer control which responds to actuation of the button by entering a diagnostic test mode.

In the diagnostic test mode, a number of tests may be performed to check the operation of various components of the exercise machine. Individual tests are provided, for example, to check the display, the keypad, sound generation system, opposition force providing means, and speed sensing means. Another test is used to display accounting data which reflects the use of the machine. For example, the displayed accounting data may include data representing the length of time the machine has been in use as well as data representing the total number of exercise movements performed on the machine such as the number of strokes performed on a rowing machine or the number of repetitions performed on a weight lifting machine. An additional test is provided to clear certain memory locations of the machine.

The diagnostic testing system of the present invention allows an operator of a health club facility to troubleshoot an exercise machine thereby avoiding costly repairs. To facilitate the performance of the testing, the system may further display messages instructing the operator as to how each diagnostic test is to be performed. In addition, the usage accounting data accumulated by the machine may be used to automatically alert the operator of the facility that the machine is in need of a service check.

These and other objects and advantages of the invention, as well as details of an illustrative embodiment, will be more fully understood from the following description and the drawings.

BEST MODE FOR CARRYING OUT THE INVENTION

Figure 1:
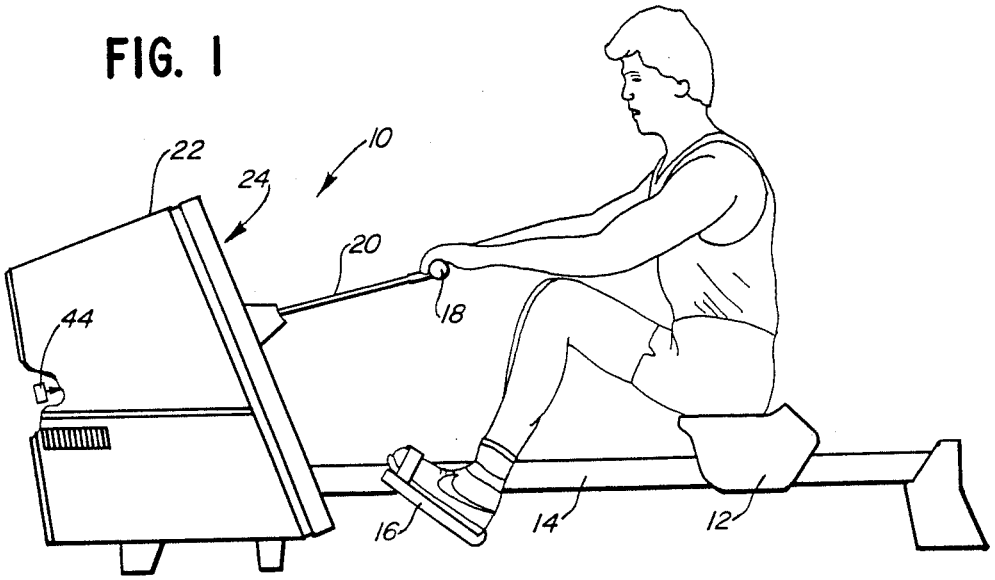
FIG. 1 is a perspective view of a rowing exercise machine employing the diagnostic testing system of the present invention.

The diagnostic testing system of the present invention may be implemented on any computer controlled exercise machine such as the rowing machine 10 shown in FIG. 1. The rowing machine 10 of FIG. 1 includes a seat 12 which is movable along an elongated rail 14. To use the machine, an individual sits upon the seat 12 with his or her feet secured in a pair of stationary foot rests 16 and grasps an exercise handle 18. The exercise handle 18 is connected to a cable 20 which may be pulled from or drawn into a cabinet 22. The rowing machine 10 may be as shown in detail in U.S. patent application Ser. Nos. 762,709 filed Aug. 5, 1985, Ser. No. 848,705 filed Apr. 4, 1986, and Ser. No. 848,684 filed Apr. 4, 1986, incorporated herein by reference, such that the cable 20 is wound about a cable drum contained in the cabinet 22, the cable drum being mounted on a shaft to which a flywheel is coupled. When the cable is drawn out from the cabinet 22 by a user, rotation is imparted to the shaft and in turn to the flywheel. Rotation of the flywheel is opposed by a brake unit 23, depicted in block form in FIG. 3, which creates a force to oppose the exercising movements of the user.

Figure 2:
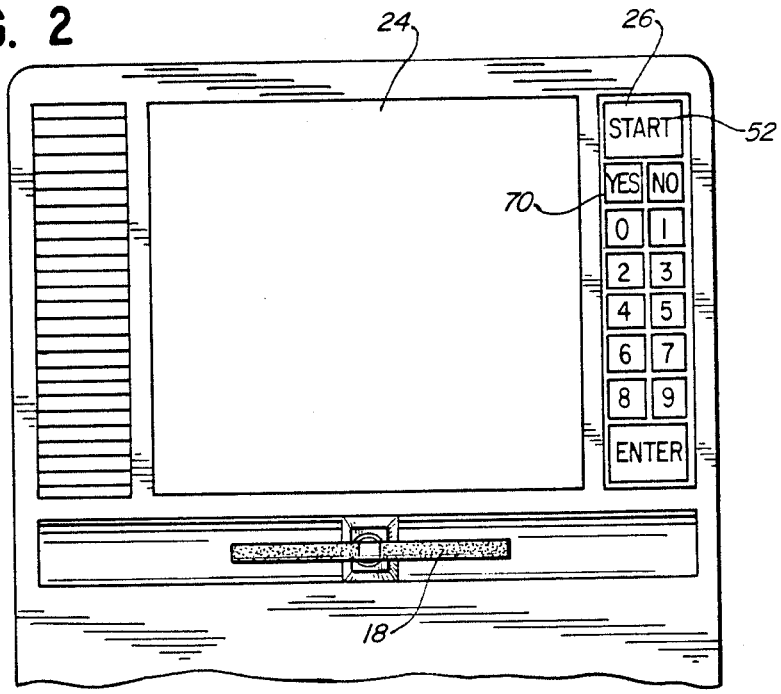
FIG. 2 is a perspective view of the display and keypad of the exercise machine shown in FIG. 1.

As shown in FIG. 2, the rowing machine 10 includes a CRT display 24 for providing information to the user during an exercise. The machine 10 also includes a keypad 26 having a plurality of alphanumeric keypad switches which allow a user to enter information to the rowing machine such as the duration of an exercise, or the level of difficulty of an exercise.

Figure 3:
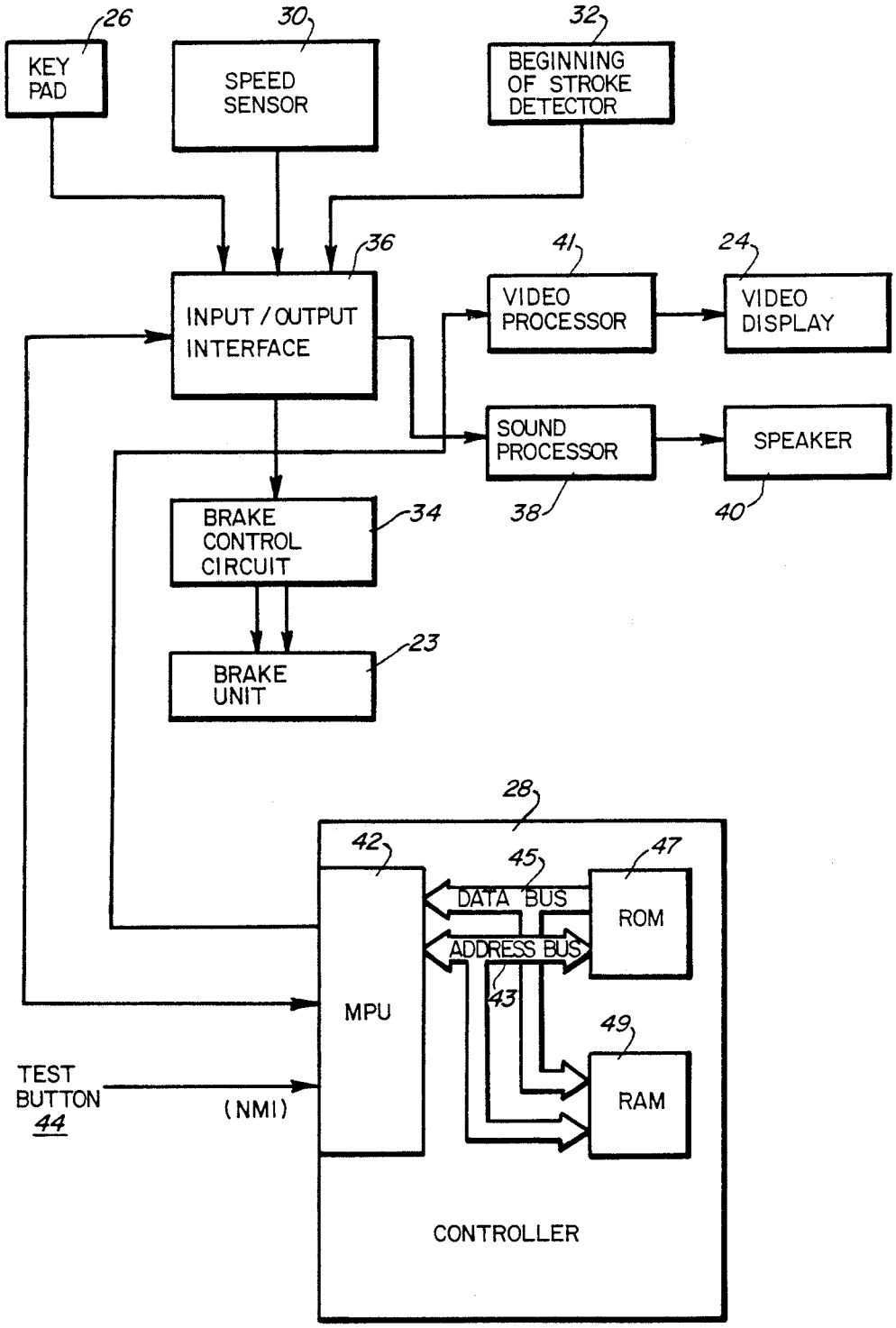
FIG. 3 is a block diagram of the exercise machine of FIG. 1.

As shown in FIG. 3, the rowing machine 10 includes a computer control 28 housed in the cabinet 22. The computer control 28 is responsive to information entered by the user on the keypad 26, the speed of the flywheel as measured by a speed sensor 30, and a beginning of stroke signal provided by a beginning of stroke detector 32 to control, through a brake control circuit 34, the amount of force to be provided by the brake unit 23 to oppose the exercising movements of a user. The computer control 28 is coupled to the keypad 26, speed sensor 30, beginning of stroke detector 32 and brake control circuit 34 through an input/output interface 36. The controller 28 further communicates with a sound processor 38 through the interface 36 in order to generate various sounds to be provided by one or more speakers 40 during the performance of a given exercise. For example, the sound processor 38 may generate sounds simulating the swishing sounds of a boat or an oar moving through water. The controller 28 controls the CRT display 24 through a video processor 41 to provide video graphics to the user during an exercise. Details of the sensor 30, detector 32, video processor 41 and display 24 as well as the sound processor 38, speaker 40, control circuit 34 and brake unit 23 may be obtained from the U.S. patent application Ser. Nos. 762,709 filed Aug. 5, 1985, Ser. No. 848,705 filed Apr. 4, 1986 and Ser. No. 848,684 filed Apr. 4, 1986.

The computer control 28 includes a microprocessor 42 which is coupled through an address bus 43 and a data bus 45 to the machine's memory which may be comprised of a ROM 47 and RAM 49. The ROM 47 stores among other things the software according to which the processor 42 operates to control the rowing machine. The RAM 49 is used as a scratch pad memory and to further accumulating machine usage data. For example, each time a rowing event is completed, the microprocessor 42 increments a value stored in the RAM 49 representing the number of rowing events performed on the machine. The microprocessor 42 also monitors the length of each rowing event and updates a value stored in the RAM 49 at the completion of each event to accumulate the total time the machine 10 has been in use. Further, each time a stroke is detected by the beginning of stroke detector 32, the microprocessor updates another value stored in the RAM 49 to accumulate data representing the total number of exercising movements, i.e. strokes, performed on the machine 10. It is noted that if the exercise machine were a weight lifting machine other usage data might be accumulated in the RAM 49 such as the number of weight lifting repetitions performed.

The microprocessor 42 is also coupled to a test button 44 which initiates the operation of various diagnostic tests to allow the components of the machine 10 to be checked for maintenance. The test button 44, as shown in FIG. 1, is contained inside the cabinet 22 and may be accessed by authorized personnel through a locked door (not shown) on the cabinet or the like. When actuated, the test button 44 provides a nonmaskable interrupt (NMI) which is applied to the microprocessor 42. The microprocessor 42 responds to an NMI by entering a diagnostic test mode if not already in that mode. If the machine is operating in the diagnostic test mode, the microprocessor 42 responds to an NMI by performing the next diagnostic test as discussed in detail below with reference to FIGS. 4A–4B.

Figure 4A:
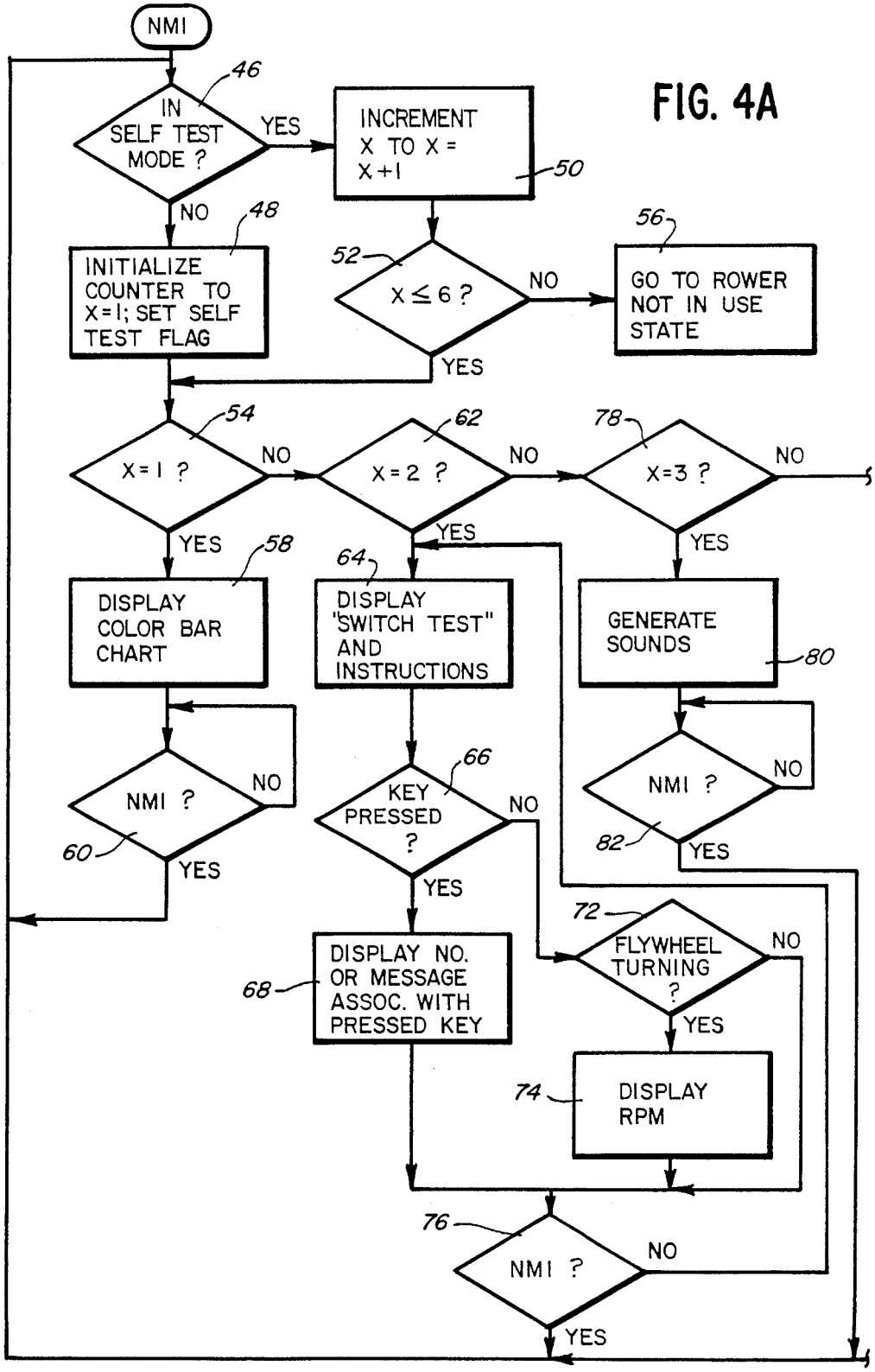
FIGS. 4A–4B form a flowchart illustrating the operation of the diagnostic testing system of the present invention.

As shown in FIG. 4A, upon receipt of an NMI, the microprocessor, at block 46, determines whether the machine is operating in the self-test mode or not. If the machine is not already in the self-test mode, the processor 42 at block 48 sets the contents of a test number counter to x=1 and sets a self-test flag. If the processor determines at block 46 that the machine is already in the self-test mode, the processor at block 50 increments the counter value x by 1. Thereafter, at block 52, the processor determines whether x is less than or equal to 6, there being 6 diagnostic tests performed. If x is less than or equal to 6, the processor goes to block 54. If x is greater than 6, the processor 42 exits the diagnostic test mode subroutine and goes to a "rower not in use" state at block 56.

The first diagnostic test is performed if it is determined by the processor at block 54 that x is equal to 1. The first test is used to check the video display 24 and more particularly the colors displayed thereon. The processor 42 at block 58 displays a color bar chart for the first test. The color chart depicts a bar of color for each color which may be displayed on the CRT 24 with each bar labelled with the name of the color that the bar is suppose to be. The personnel performing the diagnostic test may adjust various color pots on the display 24 if the colors of the bars on the chart do not correspond to the labels attached thereto. The processor 42 may also, at block 58, display instructions to the operator identifying the particular color pots which may be adjusted to correct the colors on the display. The color bar chart displayed at block 58 remains on the display 24 until the processor 42 receives another NMI from the test button 44 as determined at block 60.

In response to the second NMI, the processor 42 at block 50 increments x to x=2 and from blocks 52 and 54 proceeds to block 62 so that the second diagnostic test may be performed. The second diagnostic test is used to check the keypad 26 and the speed sensor 30. If x is equal to 2 as determined at block 62, the processor at block 64 displays "SWITCH TEST" and various instructions on the CRT display 24. The instructions indicate that if the keypad 26 is to be checked, the operator should press one of the key switches and if the speed sensor is to be checked, the operator should pull back on the handle 18. If it is determined at a block 66 that a key of the keypad 26 has been pressed, at block 68, the processor 42 displays on the CRT 24 the number or message associated with the pressed key. For example, if the yes key 70 is pressed, the microprocessor 42 causes the display 24 to display the word YES. If the word or number displayed on the CRT 24 does not correspond to the pressed key, the operator can check the key switch corresponding to that key to determine whether it is operational or not. If it is determined at block 66 that a key has not been pressed but at block 68 it is determined that the flywheel is turning, the microprocessor 42 at block 74 displays the speed of the flywheel as determined by the speed sensor 30. If the speed sensor is operating properly, the speed displayed on the CRT 24 will increase rapidly in proportion with the pulling out of the handle 18 and then drop off as the handle is returned to its starting position while the flywheel coasts to a stop. If rapid acceleration of the displayed speed is not seen, the operator may adjust the speed sensor 30. The microprocessor 42 while displaying the speed on the CRT 24 may also display instructions telling the operator what to do in the event rapid acceleration is not seen. At block 76, the processor 42 determines whether another NMI has been received or not and, if not, the processor returns to block 64.

In response to a third NMI, the microprocessor 42 at block 50 increments the counter to x=3 and at block 78 begins the third diagnostic test to check the sound generating system. In the third test, the processor 42 generates at block 80 the sounds generated during a typical exercise routine. For example, for the rowing machine 10 the microprocessor might cause the sound processor 38 to generate through the speaker 40 the sound "tone-swish-swish-tone . . . " until another NMI is received as determined at block 82. If the sounds generated are not correct, the operator may adjust the sound system.

In response to the fourth NMI, the processor increments the counter at block 50 to x=4 to initiate the fourth diagnostic test at block 84. In the fourth test, the processor 42 at block 86 displays "BRAKE TEST" and various instructions telling the operator to press a key corresponding to a desired exercise difficulty level. When the operator has selected a difficulty level as determined at block 88, the processor 42 at block 90 controls the brake unit 24 through the brake control circuit 34 to apply a force associated with the difficulty level selected. At block 90, the level selected is also displayed on the CRT 24 along with instructions to the operator to pull back on the handle 18 to determine whether the opposition force provided by the brake unit 23 is indeed the force associated with the selected difficulty level. Thereafter, the operator may select a different difficulty level or go on to the fifth diagnostic test by pressing the test button 44 to generate another NMI.

In response to the fifth NMI received as determined by the processor 42 at block 92, the processor at block 50 increments x to x=5 to initiate at block 94 the fifth diagnostic test. In the fifth diagnostic test, the processor 42 at block 96 displays on the CRT 24 the usage accounting data stored in the RAM 49 as discussed above. The usage accounting data may, for example, include the total hours and minutes the rowing machine 10 has been used, the number of events completed and the number of exercising movements performed such as strokes for a rowing machine or repetitions for a weight lifting machine. The usage accounting data is displayed on the CRT 24 until another NMI is received by the microprocessor 42 as determined at block 98.

In response to the sixth NMI, the processor 42 increments at block 50 the counter to x=6 and proceeds to block 100 to display on the CRT 24 the message "CLEAR INITIALS AND DISTANCE YES NO". By pressing the yes button 70 on the keypad 26, the operator may clear the initials of the top rower and his distance previously stored in the RAM 49. Thereafter, in response to a subsequent NMI as determined at block 102, the processor 42 at block 50 increments the counter to x=7 and from block 52 goes to block 56 exiting the diagnostic test mode subroutine.

Figure 4B:
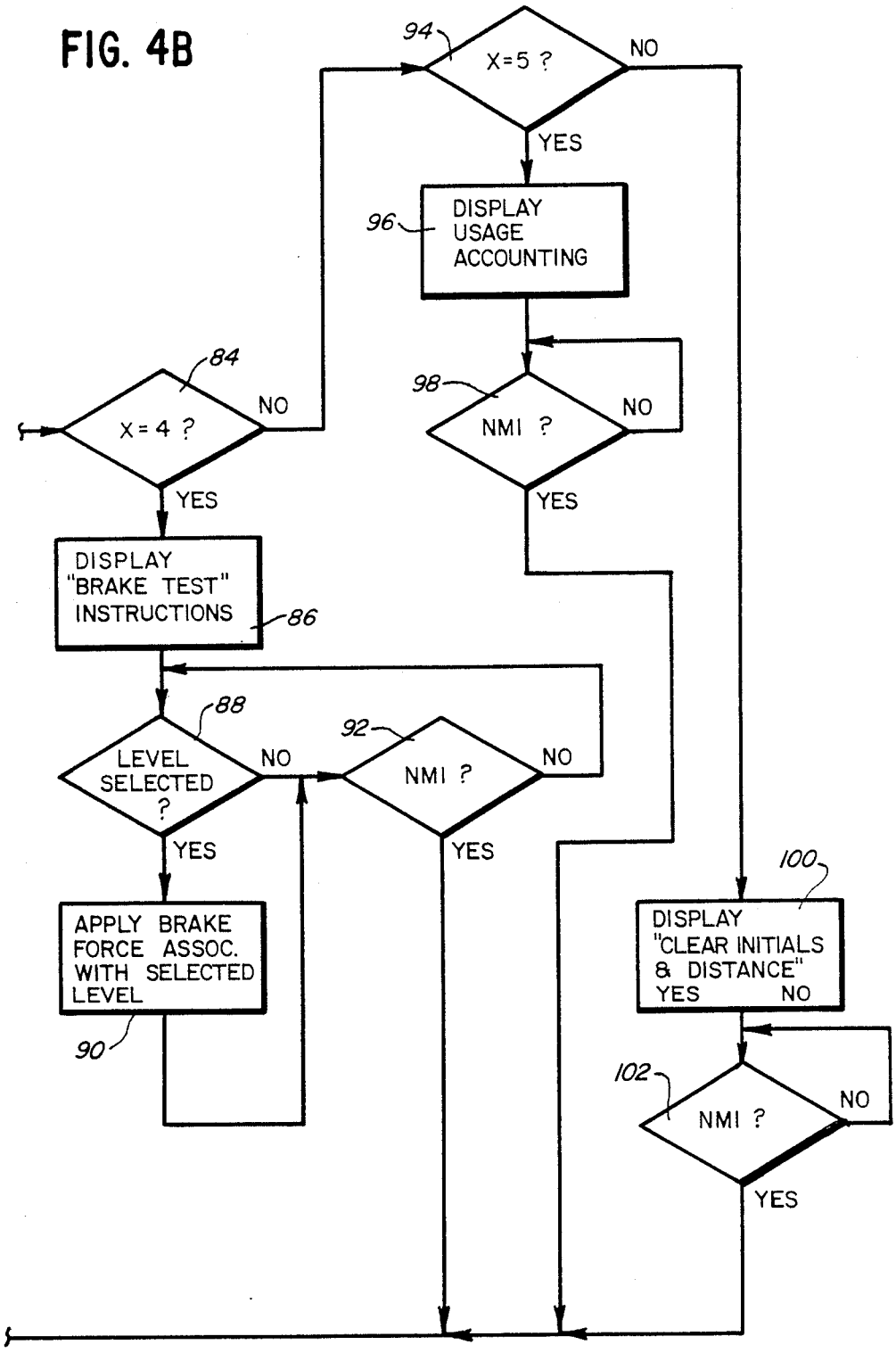

The six diagnostic tests illustrated with respect to the flowchart of FIGS. 4A and 4B are just examples of the tests which may be performed by a diagnostic testing system for an exercise machine according to the present invention. Further, the processor 42 may be controlled to monitor the usage accounting data stored in the RAM 49 after the completion of each exercise event by comparing the accounting data to reference data in order to determine whether the machine has been operating for a given amount of time or has had performed thereon a given number of exercising movements which would indicate that the machine is ready for a service check. If the usage accounting data is greater than the reference data indicating that the machine should be checked, the processor 42 may control the display 24 to display a message indicating that the machine should be serviced. If the processor 42 is coupled to a main health club computer having its own display, the message may be displayed on the main computer's display as opposed to the display 24 to alert the operator directly that servicing of the machine is required.

We claim:

1. In an exercise machine having a plurality of components including means for providing a force to oppose exercising movements of a user, a diagnostic system to allow various of said components to be checked for maintenance comprising:

input means actuable by authorized personnel for initiating diagnostic testing of one or more of said components; and processing means for controlling in a test mode the operation of a plurality of said components including said opposition force providing means, said processing means being responsive to said input means for controlling said opposition force means to operate in said test mode.

2. The exercise machine of claim 1 including selection means operable by a user for selecting a level of force to oppose the user's movements, said processing means being responsive to the actuation of said input means and to the selection of an opposition force level by said selection means to control said opposition force providing means to provide a force level equal to the selected level in said test mode.

3. The exercise machine of claim 1 wherein said plurality of components further includes a color display, said processing means being responsive to said input means to control the display to depict various colors with the name of the color specified thereon.

4. The exercise machine of claim 1 wherein said plurality of components includes means for generating sounds during the operation of the machine, said processing means being responsive to the actuation of said input means to control said sound generator to generate various sounds generated during the operation of the exercise machine.

5. The exercise machine of claim 1 wherein said plurality of components includes a display and a keypad having a plurality of switches representing alphanumeric information, said keypad switches being operable by a user for coupling alphanumeric information to said processing means, said processing means being responsive to the actuation of said input means and the subsequent actuation of a keypad switch to control said display to display the alphanumeric information represented by said switch.

6. In an exercise machine, a diagnostic system to allow said exercise machine to be checked for maintenance comprising:

input means actuable by authorized personnel for initiating diagnostic testing;

means for displaying information to a user during operation of the machine;

means for accumulating maintenance data resulting from the operation of the exercise machine; and processing means for controlling the display means and accumulating means, said processing means being responsive to said input means for controlling the display to display said maintenance data accumulated by said accumulating means.

7. The exercise machine of claim 6 wherein said means for accumulating maintenance data includes means for monitoring the amount of time the exercise machine is in use.

8. The exercise machine of claim 6 further including a user interface adapted to accept user exercising movement and means for sensing the number of user exercising movements performed on said machine, said processing means being responsive to said input means to control the display means for displaying said maintenance data relating to the number of exercising movements accumulated in said accumulated means.

9. The exercise machine of claim 6 wherein said processing means includes means for comparing said machine operating data to reference data and further indicating means for automatically providing an indication that a service check should be performed on the machine when said machine operating data is greater than or equal to said reference data.

10. In an exercise machine having a plurality of components including means for providing a force to oppose exercising movements of a user, a diagnostic system to allow various of said components to be checked, comprising:

input means actuable by authorized personnel for initiating diagnostic testing of said exercise machine;

means for displaying information to a user during operation of the machine; and processing means for controlling a plurality of the machine's components including said opposition force providing means and said display means, said processing means being responsive to said input means to control a component to operate in a test mode and to control said display to display instructions on how to perform a test for said component.

11. An exercise machine diagnostic system comprising:

a data storage memory; and means for accumulating maintenance data for said exercise machine including:

means for monitoring the amount of time the exercise machine has been in use and storing said time data in said data storage memory; and means for monitoring the number of exercising movements performed during the time the exercise machine has been in use and storing said exercising movement data in said data storage memory.

12. The exercise machine of claim 11 further comprising processing means operatively connected to said data storage memory for comparing said time and exercising movement data to reference data and further including means for automatically providing an indication that a service check should be performed on the machine when said time or exercising movement data is greater than or equal to said reference data.

13. The exercise machine of claim 11 wherein said exercise machine includes means for generating a force to oppose exercising movements of a user and means for diagnostic testing of said opposition force generator.

14. The exercise machine of claim 11 wherein said exercise machine includes means for sensing the speed which an exercising movement is being performed and means for diagnostic testing of said speed sensor.

15. The exercise machine of claim 11 further compromising input means for initiating testing by authorized personnel of at least one component of the machine.

* * * * *